US008544479B2

(12) United States Patent
Shyu

(10) Patent No.: US 8,544,479 B2
(45) Date of Patent: Oct. 1, 2013

(54) HAIRCLIP DEVICE

(76) Inventor: Shyh-Ming Shyu, Tainan (TW)

( * ) Notice: Subject to any disclaimer, the term of this patent is extended or adjusted under 35 U.S.C. 154(b) by 0 days.

(21) Appl. No.: 13/354,420

(22) Filed: Jan. 20, 2012

(65) Prior Publication Data

US 2013/0186425 A1 Jul. 25, 2013

(51) Int. Cl.
*A45D 8/00* (2006.01)
*A44B 19/00* (2006.01)

(52) U.S. Cl.
USPC ..... 132/273; 24/490; 24/518

(58) Field of Classification Search
USPC ..... 132/273–284, 222, 255, 231, 234, 132/246–249; 24/490, 518–519, 709.3
See application file for complete search history.

(56) References Cited

U.S. PATENT DOCUMENTS 5,771,908 A * 6/1998 Dorsey ..... 132/275
6,305,387 B1 * 10/2001 Atchison ..... 132/278
D582,095 S * 12/2008 Minnelli ..... D28/42
7,963,290 B2 * 6/2011 Havlin ..... 132/210
2006/0174908 A1 * 8/2006 Srivastava ..... 132/275
2010/0108091 A1 * 5/2010 Lay ..... 132/279
2011/0023906 A1 * 2/2011 Tu ..... 132/278

FOREIGN PATENT DOCUMENTS

FR 2693637 * 7/1992

* cited by examiner

*Primary Examiner* — Robyn Doan
*Assistant Examiner* — Brianne Kalach
(74) *Attorney, Agent, or Firm* — Alan Kamrath; Kamrath IP Lawfirm, P.A.

(57) ABSTRACT

A hairclip device includes a clip body having a hair clipping space through which a portion of hair of a user is adapted to pass. The hairclip device further includes a fixing member having a detaining portion and a pyramidal coupling portion. The detaining portion of the fixing member is connected with an end portion of the clip body. The coupling portion of the fixing member is detachably engaged in the other end portion of the clip body for positioning the clip body on the head of the user. The hairclip device can maintain a hairdo stably and can be easily removed from the user's head in order that the user can arrange different hairdos conveniently.

10 Claims, 10 Drawing Sheets

HAIRCLIP DEVICE

BACKGROUND OF THE INVENTION

1. Field of the Invention

The present invention relates to a hairclip device and, more particularly, to a hair styling device for arranging the hair of a user into a predetermined hairdo while maintaining the hairdo in place.

2. Description of the Related Art

A hairclip device is a tool for arranging a hairdo. A conventional hairclip device of the type having an annular clip body includes fixing members, e.g. hooking members, disposed at two end of the clip body. A space is provided in the clip body for a portion of the hair of a user, e.g. a ponytail, to pass through. In use, the hair of the user is passed through the clip body, and the clip body is rolled up so that the hair is formed as a bob. Then, the clip body is bent in a ring shape so that the two fixing members at the two ends of the clip body can be combined together to have the hairdo fixed. However, the hair clip of the conventional hairclip device still can not have the hair fastened firmly. Also, it is inconvenient for the user to have the clip body bent in a ring shape and to have the clip body restored to its flat form. Furthermore, the coupling structure of the fixing members for fixing a hairdo makes it inconvenient and difficult for the hairclip device to be removed from the user's head.

BRIEF SUMMARY OF THE INVENTION

Therefore, an objective of the present invention is to provide a hairclip device to improve the aforementioned shortcoming and deficiency of the prior art. With the hairclip device of the present invention, various hairdos can be arranged conveniently for the hair of a user. Furthermore, the hairclip device of the present invention can be easily removed from the user's head.

To achieve the foregoing objective, a hairclip device of the present invention includes a clip body and a fixing member. The clip body includes first and second end portions spaced in a length direction and first and second arms interconnected between the first and second end portions. A coupling space is defined in each of the first and second end portions. The first and second arms are spaced, and a hair clipping space is defined between the first and second arms for hair of a user to pass through. The coupling spaces of the first and second end portions are formed by expanding two ends of the hair clipping space respectively. The fixing member includes a detaining portion and a coupling portion. The detaining portion is connected with the first end portion of the clip body. The coupling portion is extended from an end of the detaining portion and engaged detachably in the coupling space of the second end portion of the clip body for positioning the clip body on the head of the user. The hairclip device can maintain a hairdo stably and can be easily removed from the user's head in order that the user can arrange different hairdos conveniently.

In a preferred form, the detaining portion includes a slot therein and extends through the coupling space of the first end portion of the clip body. The fixing member has a length in the length direction approximately the same as that of the clip body in the length direction.

In a preferred form, the clip body and the fixing member are made of a flexible material. A gap in a middle of the hair clipping space is larger than that in each of two ends of the hair clipping space. Each of the coupling spaces of the first and second end portions is in communication with the hair clipping space and is in a rough C-shape. The detaining portion includes spaced first and second sections. A first end of the first section is integrally engaged with a first end of the second section, and a second end of the first section is detachably coupled with a second end of the second section.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
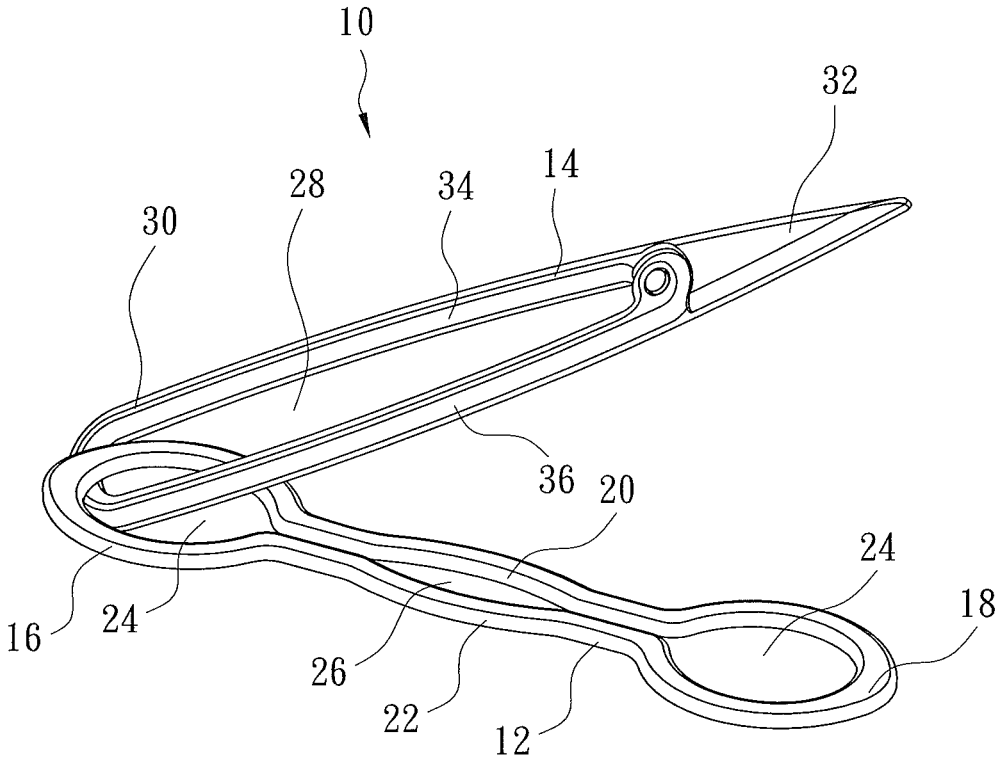
FIG. 1 is a perspective view of a hairclip device according to the present invention.
Figure 2:
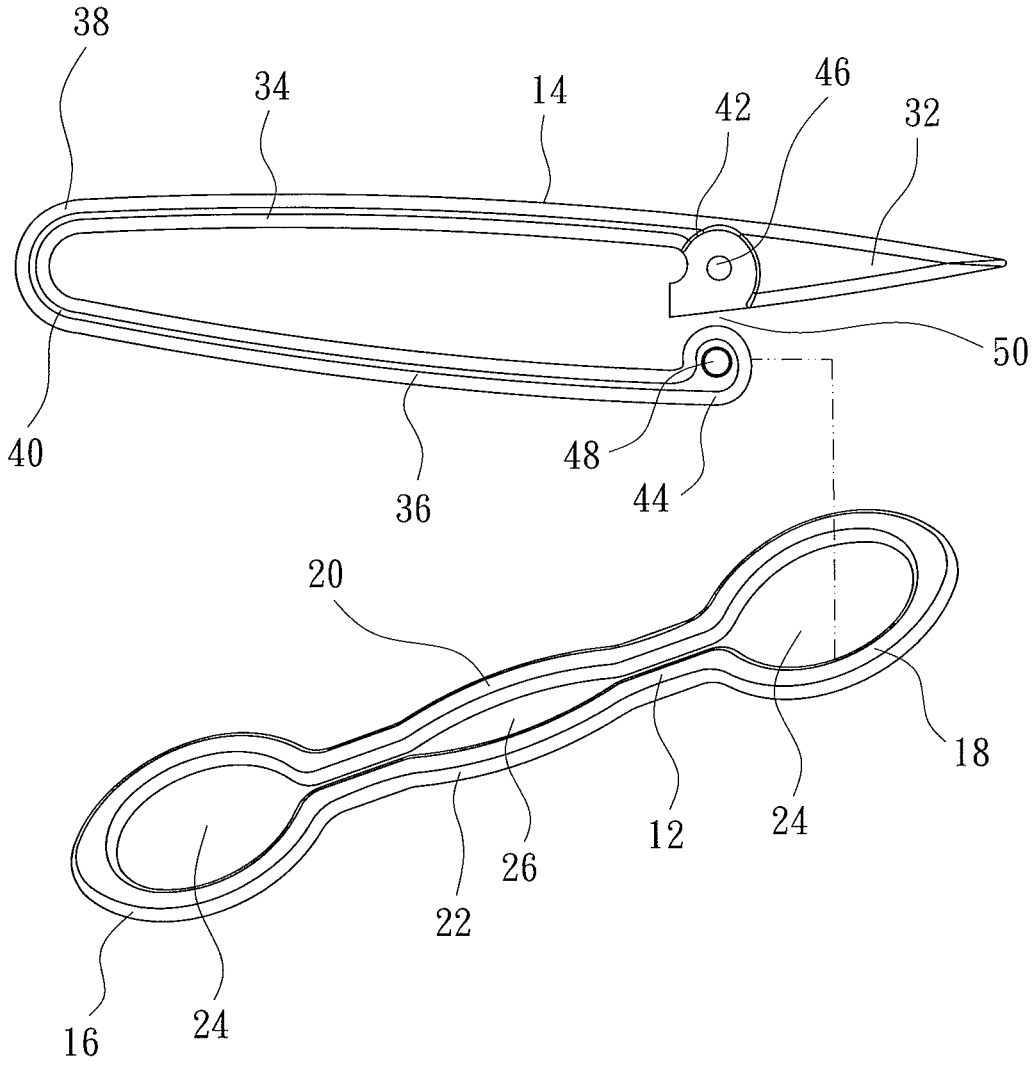
FIG. 2 shows an exploded, perspective view of the hairclip device of FIG. 1 with a fixing member of the hairclip device in an open state.
Figure 3:
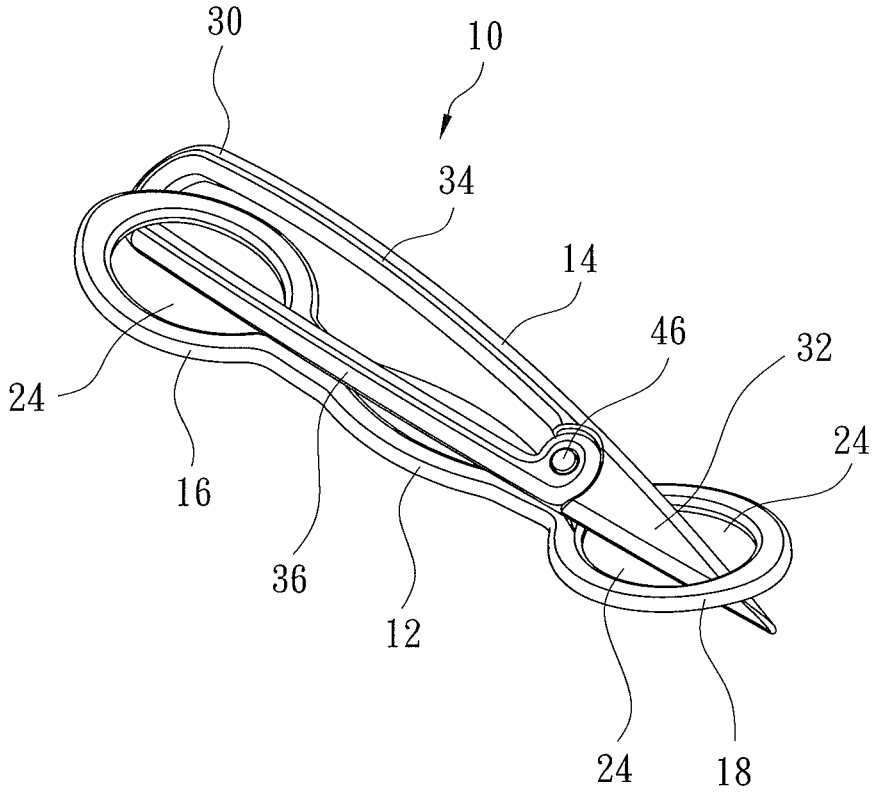
FIG. 3 shows a perspective view of the hairclip device of FIG. 1 with a coupling portion of the fixing member inserted into a second end portion of a clip body of the hairclip device.

A hairclip device of an embodiment of the present invention is shown in FIGS. 1 through 10 of the drawings and generally designated 10. The hairclip device 10 is adapted to be used for arranging the hair of a user into various hairdos. The hairclip device 10 includes a clip body 12 and a fixing member 14 connected with the clip body 12. According to the preferred form shown, the clip body 12 and the fixing member 14 are made of a flexible material such as plastic, so that the clip body 12 and the fixing member 14 can be bent or twisted by an external force without breaking.

The clip body 12 includes first and second end portions 16 and 18 spaced in a length direction, and opposed first and second arms 20 and 22 interconnected between the first and second end portions 16 and 18. A rough C-shaped coupling space 24 is defined in each of the first and second end portions 16 and 18. The first and second arms 20 and 22 extend in the length direction, and a hair clipping space 26 is defined between the first and second arms 20 and 22 for a portion of the hair of the user to pass through. In this embodiment, a gap in a middle of the hair clipping space 26 is larger than that in each of two ends of the hair clipping space 26. The coupling spaces 24 of the first and second end portions 16 and 18 are formed by expanding two ends of the hair clipping space 26 and are in communication with the hair clipping space 26.

Figure 4:
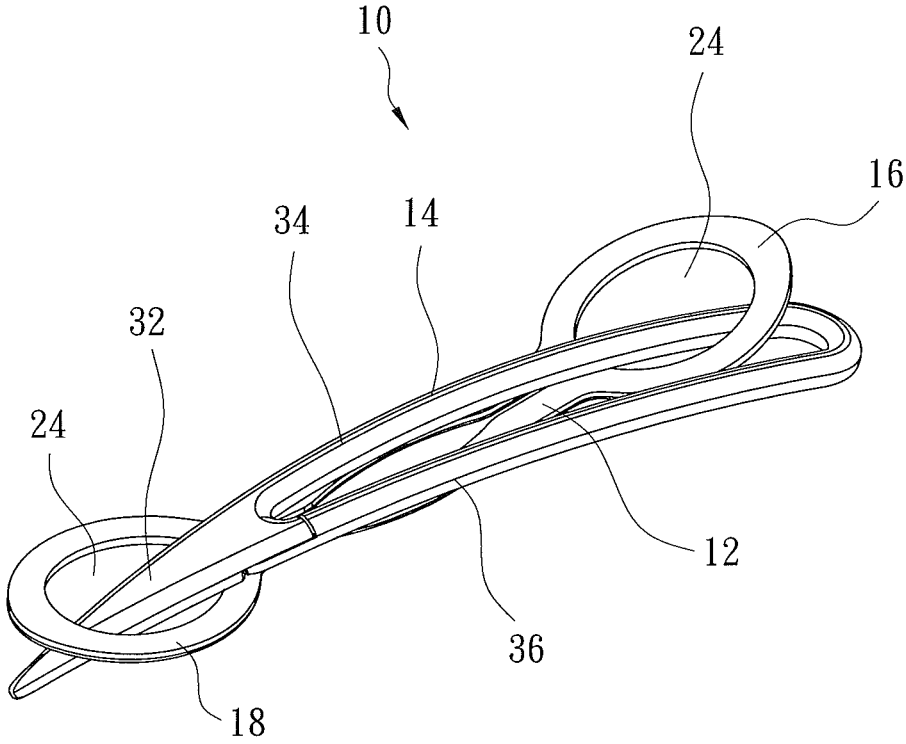
FIG. 4 shows a perspective view of the hairclip device of FIG. 1 with the coupling portion of the fixing member being inserted reversely into the second end portion of the clip body of the hairclip device.

The fixing member 14 includes a detaining portion 30 and a pyramidal coupling portion 32. The detaining portion 30 includes a slot 28 and extends through the coupling space 24 of the first end portion 16 to form a buckle connection with the first end portion 16 of the clip body 12. In this embodiment, the detaining portion 30 includes spaced first and second sections 34 and 36 opposite to each other. A first end 38 of the first section 34 is integrally engaged with a first end 40 of the second section 36, and a second end 42 of the first section 34 is coupled detachably with a second end 44 of the second section 36. More specifically, a protruded block 46 is formed on the second end 42 of the first section 34, and a through-hole 48 is formed in the second end 44 of the second section 36 for the protruded block 46 to be inserted into and coupled together. When the second end 42 of the first section 34 is detached from the second end 44 of the second section 36, an opening 50 is formed between the second end 42 of the first section 34 and the second end 44 of the second section 36 (see FIG. 2), so that the second section 36 of the detaining portion 30 can be extended through the coupling space 24 of the first end portion 16. On the other hand, when the protruded block 46 of the first section 34 and the through-hole 48 of the second section 36 are coupled together, the detaining portion 30 and the first end portion 16 of the clip body 12 are buckled together (see FIG. 1). The coupling portion 32 is extended from an end of the detaining portion 30. In this embodiment, the coupling portion 32 is extended from the second end 42 of the first section 34 of the detaining portion 30. Furthermore, the fixing member 14 has a length in the length direction approximately the same as that of the clip body 12 in the length direction. Thus, when the detaining portion 30 of the fixing member 14 is connected with the first end portion 16 of the clip body 12, the coupling portion 32 of the fixing member 14 can be inserted into the coupling space 24 of the second end portion 18 of the clip body 12 to be coupled together (see FIGS. 3 and 4). As shown in FIG. 4, the coupling portion 32 of the fixing member 14 can be bent and inserted reversely into the second end portion 18 of the clip body 12, which is favorable for the coupling of the fixing member 14 with the clip body 12.

Figure 5:
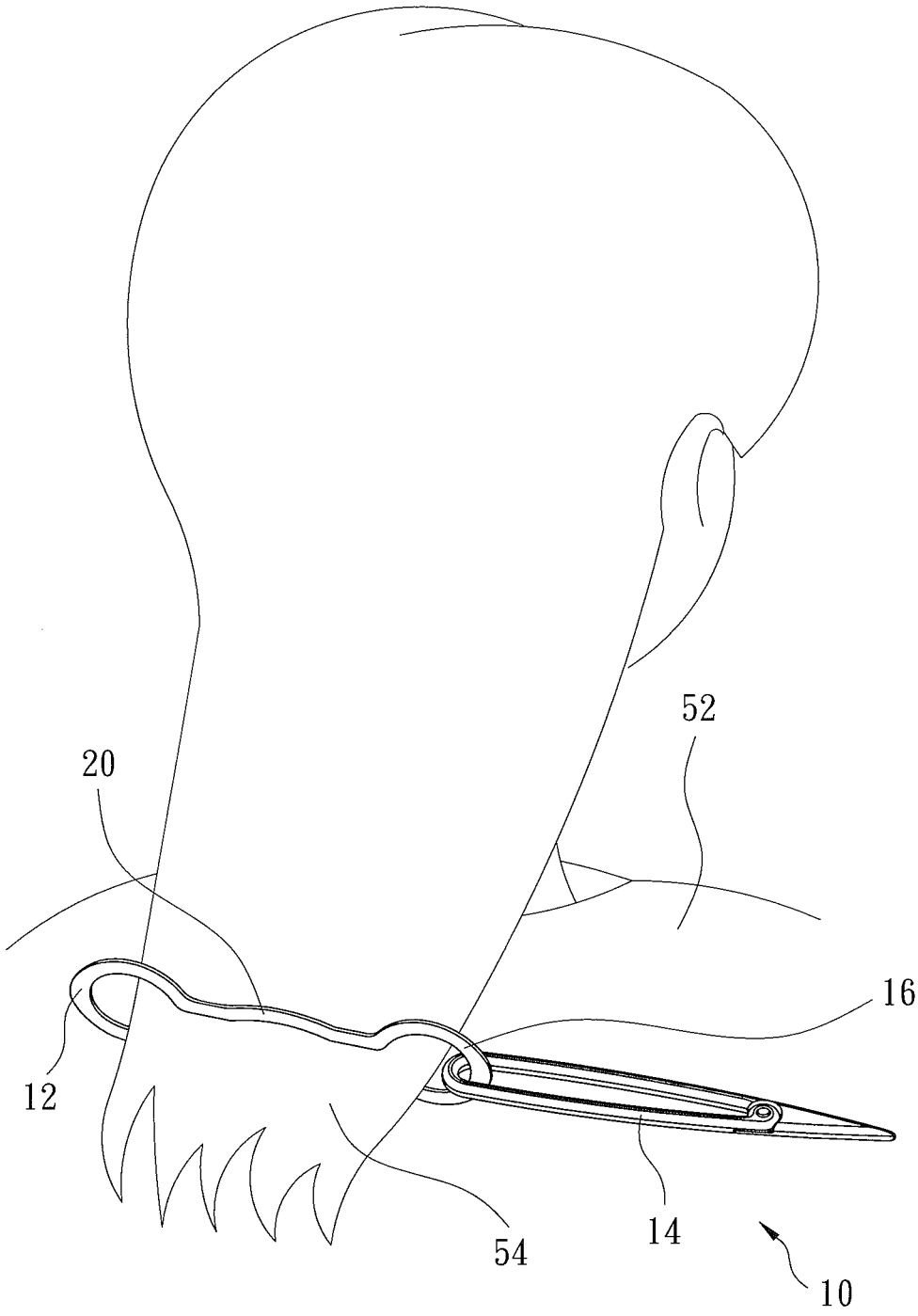
FIG. 5 is an illustration of expanding a hair clipping space of the clip body of the hairclip device of FIG. 1, with a portion of the hair of a user extending through the hair clipping space.
Figure 6:
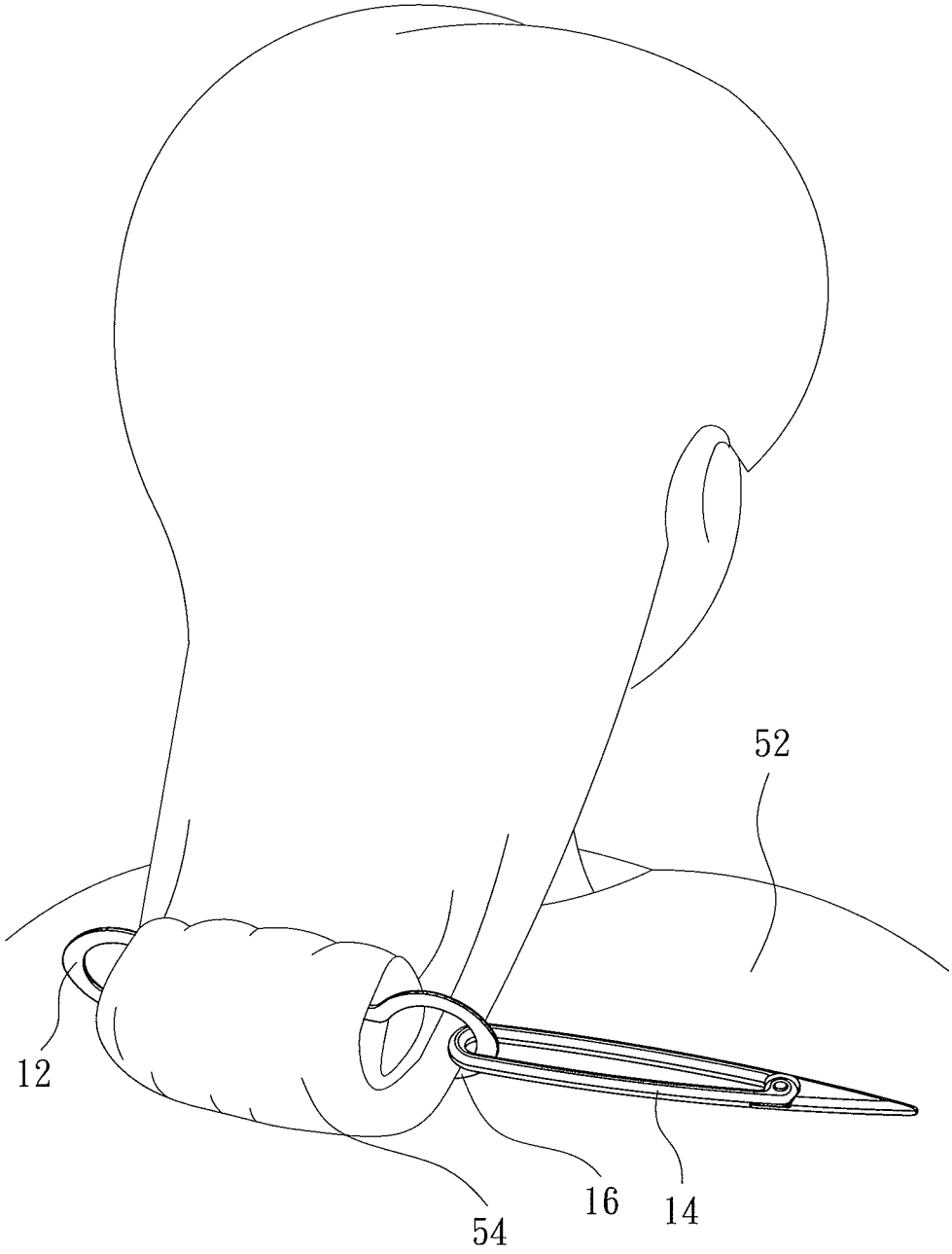
FIG. 6 is an illustration of the hairclip device of FIG. 5 being rolled up outwardly.
Figure 7:
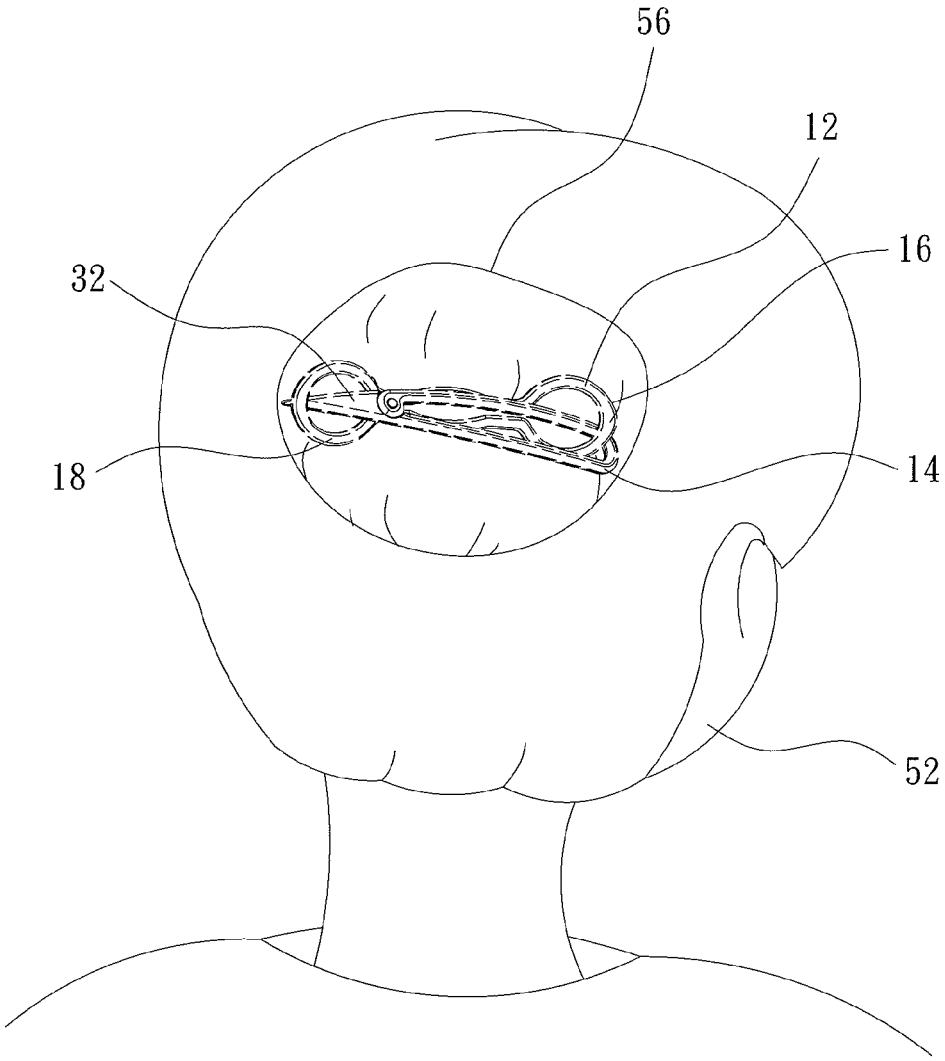
FIG. 7 is an illustration of a hairdo being maintained by having the fixing member coupled with the clip body of the hairclip device of FIG. 6.
Figure 8:
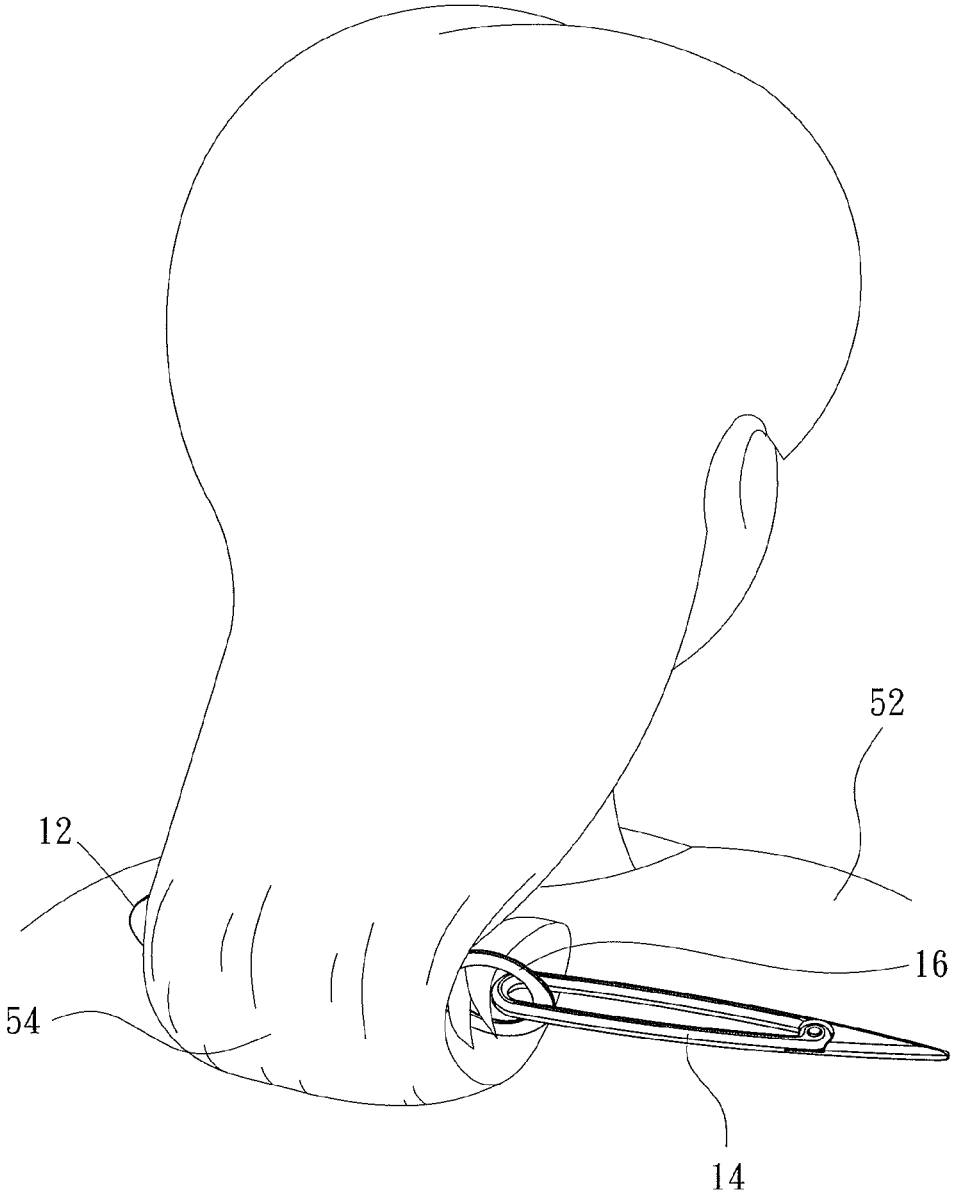
FIG. 8 is an illustration of the hairclip device of FIG. 5 being rolled up inwardly.
Figure 9:
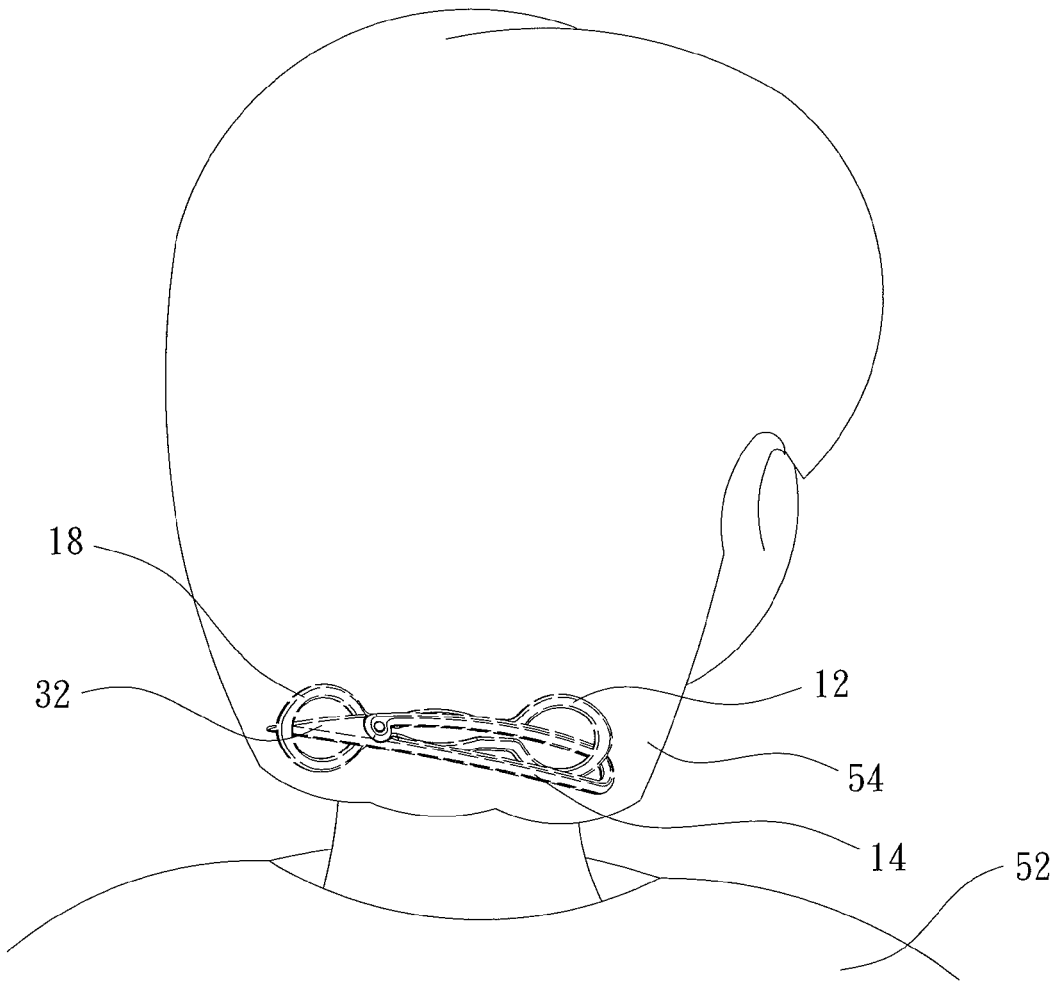
FIG. 9 is an illustration of a hairdo being maintained by having the fixing member coupled with the clip body of the hairclip device of FIG. 8.
Figure 10:
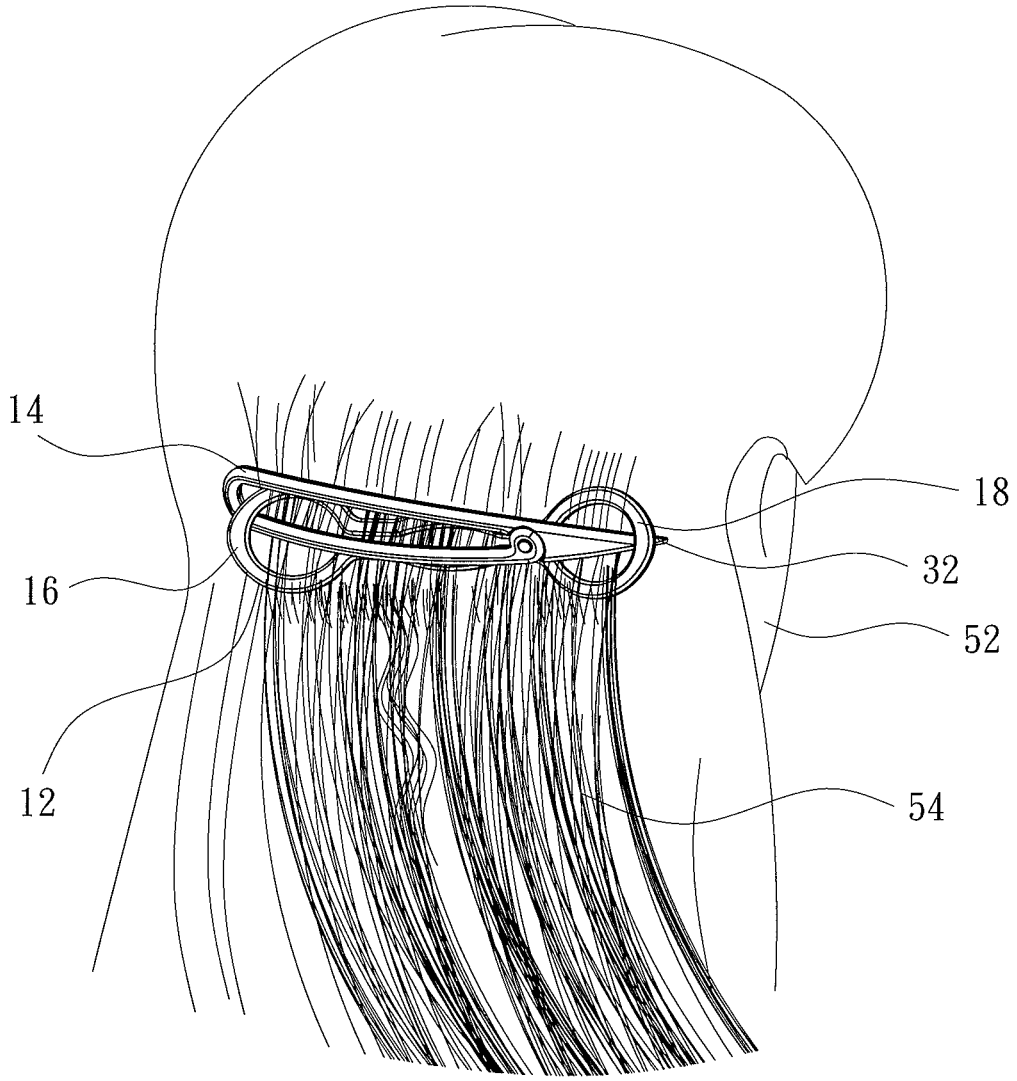
FIG. 10 is an illustration of another hairdo arranged by using the hairclip device of FIG. 1.

When using the hairclip device 10 of the present invention, the first and second arms 20 and 22 of the clip body 12 can be pulled outwardly to expand the hair clipping space 26, and a portion of the hair 54 of the user 52 can extend through the hair clipping space 26 (see FIG. 5). The hair 54 will be fastened by the first and second arms 20 and 22 when they are released and restored to their original positions. FIG. 6 is an illustration of the clip body 12 of FIG. 5 being rolled up outwardly. FIG. 7 shows the hair 54 with the rolled-up clip body 12 in FIG. 6 is formed as a bob 56 or a bun on the back of the head of the user 52, and the coupling portion 32 of the fixing member 14 is inserted into the second end portion 18 of the clip body 12 so that the clip body 12 is positioned on the head of the user 52 and underneath the hair 54 of the user 52. FIG. 8 is an illustration of the clip body 12 of FIG. 5 being rolled up inwardly. FIG. 9 shows the hair 54 with the rolled-up clip body 12 in FIG. 8 is formed as a short hairdo on the nape of the neck of the user 52, and the coupling portion 32 of the fixing member 14 is inserted into the second end portion 18 of the clip body 12 so that the clip body 12 is positioned on the head of the user 52. FIG. 10 is an illustration of the hair 54 of the user 52 extending through the hair clipping space 26 and arranged into another hairdo by having the coupling portion 32 of the fixing member 14 engaged in the second end portion 18 of the clip body 12. The hairclip device 10 is designed in such a way that it is favorable for the user 52 to arrange hair 54 into various hairdos, and the hairdos can be maintained reliably. When the hairclip device 10 is required to be removed from the head of the user 52, the coupling portion 32 of the fixing member 14 is simply removed from the second end portion 18 of the clip body 12, which is very convenient in usage.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A hairclip device comprising:

a clip body including first and second arms inseparably interconnected between first and second end portions spaced in a length direction, with a coupling space defined between the first and second arms in each of the first and second end portions, with the first and second arms being spaced perpendicular to the length direction, with a hair clipping space defined between the first and second arms for hair of a user to pass through, with the coupling spaces of the first and second end portions formed by expanding two ends of the hair clipping space respectively, with each coupling space of the first and second end portions being in communication between the first and second arms with the hair clipping space; and a fixing member including a detaining portion and a coupling portion, with the detaining portion connected with the first end portion of the clip body, with the coupling portion extending from an end of the detaining portion and engaged detachably in the coupling space of the second end portion of the clip body, wherein the coupling portion of the fixing member is insertable reversely into the coupling space of the second end portion of the clip body, with the detaining portion of the fixing member including a slot therein, with the first arm intermediate the first and second end portions extending through the slot of the detaining portion and the second arm located outside the slot of the detaining portion, with the detaining portion of the fixing member being moveable between the coupling spaces of the first and second end portions in the length direction through the hair clipping space, with the detaining portion including spaced first and second sections, with a first end of the first section integrally engaged with a first end of the second section, with a second end of the first section coupled detachably with a second end of the second section, with the slot defined between the first ends of the first and second sections and the second ends of the first and second sections coupled together.

2. The hairclip device according to claim 1, with the coupling portion of the fixing member being pyramidal, and with the fixing member having a length in the length direction approximately the same as that of the clip body in the length direction.

3. The hairclip device according to claim 2, with the clip body and the fixing member made of a flexible material, with a gap in a middle of the hair clipping space larger than that in each of two ends of the hair clipping space, and with each of the coupling spaces of the first and second end portions being in a rough C-shape.

4. The hairclip device according to claim 2, with the coupling portion extending from the second end of the first section of the detaining portion, with a through-hole formed in the second end of the second section of the coupling portion, and with a protruded block formed on the second end of the first section and detachably received within the through-hole of the second section of the coupling portion.

5. The hairclip device according to claim 1, with the coupling portion extending from the second end of the first section of the detaining portion, with a through-hole formed in the second end of the second section of the coupling portion, and with a protruded block formed on the second end of the first section and detachably engaged within the through-hole of the second section of the coupling portion.

6. The hairclip device according to claim 5, wherein the coupling portion has a pyramidal shape in a plane including the first and second sections, with the protruded block and the through-hole extending generally perpendicular to the plane including the first and second sections of the detaining portion.

7. The hairclip device according to claim 6, wherein a gap between the first and second arms is larger intermediate the coupling spaces than adjacent the coupling spaces of the first and second end portions.

8. The hairclip device according to claim 5, wherein each coupling space of the first and second end portions is in a rough C-shape, with each coupling space having a size perpendicular to the length direction greater than a size of the hair clipping space perpendicular to the length direction.

9. The hairclip device according to claim 1, wherein a gap between the first and second arms is larger intermediate the coupling spaces than adjacent the coupling spaces of the first and second end portions.

10. The hairclip device according to claim 9, wherein each coupling space of the first and second end portions is in a rough C-shape, with each coupling space having a size perpendicular to the length direction greater than a size of the hair clipping space perpendicular to the length direction.

* * * * *